US005441001A

United States Patent [19]

Conley, Jr. et al.

[11] Patent Number: 5,441,001

[45] Date of Patent: Aug. 15, 1995

[54] EASY LOADING SEWING STATION

[75] Inventors: Ralph F. Conley, Jr.; Ricky J. Frye, both of Miamisburg; Clint E. Gehres, Moraine, all of Ohio

[73] Assignee: MIM Industries, Inc., Miamisburg, Ohio

[21] Appl. No.: 945,274

[22] Filed: Sep. 14, 1992

[51] Int. Cl.[6] ..... D05B 21/00

[52] U.S. Cl. ..... 112/470.18; 112/470.14

[58] Field of Search ..... 112/121.15, 121.15, 112/114, 113, 104, 311, 265.1, 260

[56] References Cited

U.S. PATENT DOCUMENTS

| | | | |
|---|---|---|---|
| 3,799,086 | 3/1974 | Block | 112/121.15 |
| 3,869,998 | 3/1975 | Scholl | 112/121.15 |
| 4,275,673 | 6/1981 | Boser et al. | 112/105 |
| 4,534,303 | 2/1985 | Off et al. . | |
| 4,690,078 | 9/1987 | Off et al. | 112/121.15 |
| 4,883,006 | 6/1989 | Marii et al. . | |
| 5,014,633 | 11/1991 | Murata et al. . | |
| 5,024,174 | 10/1991 | Ferguson . | |

*Primary Examiner*—Clifford D. Crowder

*Assistant Examiner*—Paul C. Lewis

*Attorney, Agent, or Firm*—Biebel & French

[57] ABSTRACT

A sewing station is disclosed including a workpiece clamp shuttle for loading and shuttling a bulky workpiece to be sewn to a sewing location of a sewing machine. The workpiece clasp shuttle includes a support surface for supporting a bulky workpiece and a clamp for clamping the bulky workpiece to the support surface at a loading station wherein the bulky workpiece may be easily loaded onto the support surface. The sewing machine includes apparatus for driving the clamp and the support surface from the loading station to the sewing location where the bulky workpiece can be sewn. In addition, a method for sewing a bulky workpiece in a sewing station is disclosed including the steps of preclamping the bulky workpiece at a loading location, and transferring the preclamped bulky workpiece from the loading location to a sewing location where the workpiece may be clamped and sewn. The method further includes the step of clamping the workpiece at the sewing location and discontinuing the preclamping step prior to the workpiece being sewn.

8 Claims, 3 Drawing Sheets

EASY LOADING SEWING STATION

BACKGROUND OF THE INVENTION

1. Field of the Invention

This invention relates to a sewing station having a preclamp, and more particularly, to a sewing station having a preclamp which facilitates transfer of bulky workpieces from a loading location to a sewing location within the sewing station.

2. Description of Related Art

In the sewing industry, it is typical for a sewing operation to require that an operator place a workpiece, for example two pieces of cloth to be sewn together, underneath a sewing head where the workpiece is then clamped to a cloth plate such that the operator may then remove his hands and the cloth plate and clamp are then driven in a predetermined pattern under the sewing head to cause the workpiece to be sewn. In order to facilitate loading and placement of the workpiece underneath the sewing head, the workpiece may be first loaded and manually clamped to a pallet which is subsequently coupled to a drive mechanism at the sewing head where a sewing operation is performed on the workpiece.

The use of a pallet to load workpieces into a sewing station has typically been limited to use with workpieces which have dimensions on the same order as the size of the pallet and which are capable of lying relatively flat on the pallet such that the pallet may be easily picked up or otherwise moved to the sewing station. Mounting of oversized workpieces on the pallet may result in the workpiece interfering with efficient coupling of the pallet to the drive mechanism for the sewing operation and further may interfere with handling or movement of the pallet from a loading location to the sewing station. In addition, clamping structures commonly used with known pallets are generally unsatisfactory for operating on large, unwieldy or bulky workpieces.

Thus, when a large or bulky workpiece is to be sewn, it is necessary for an operator to manually place the unwieldy or bulky workpiece directly underneath the sewing head where the workpiece is then clamped to a cloth plate for manipulation by a drive mechanism during the sewing operation. It should be therefore apparent that it is necessary to forego the advantages provided by a pallet system when a large or bulky workpiece is to be operated upon such that the inefficiencies associated with manually placing a workpiece directly in the sewing station are compounded as the access room underneath the sewing head is limited.

An example of a workpiece having a bulky construction which must be manually placed directly underneath the sewing head prior to the sewing operation is an automobile air bag having a substantially circular configuration wherein the end of straps used for limiting the inflation of the bladder portion of the bag must be sewn to an exterior surface of the bag. A workpiece having this bulky construction cannot be easily loaded to any known pallet, nor can such a workpiece be conveniently held in an assembled condition prior to placement under the sewing head.

SUMMARY OF THE INVENTION

In one aspect, this invention includes a sewing station comprising a clamp having means for permitting unimpeded loading of bulky workpieces wherein the clamp is movable from a loading to a sewing location.

In a further aspect, this invention includes a sewing station for providing easy loading of bulky workpieces to be sewn, the sewing station comprising a support surface; clamp means for clamping a workpiece to the support surface at a discrete area spaced from the peripheral edges of the workpiece, the clamp means being movable to a first position relative to the support surface such that unobstructive access to the support surface is provided for easy loading of the workpiece; means for guiding the clamp means toward a sewing location; and a sewing clamp located at the sewing location for clamping the workpiece to the support surface wherein the sewing clamp is adapted to hold the workpiece in engagement with the support surface independently of the clamp means.

In yet another aspect, this invention includes a method of loading bulky workpieces in a sewing station comprising the steps of preclamping a bulky workpiece at a loading location and transferring the workpiece to a sewing location. Subsequently, the workpiece is clamped at the sewing location and the preclamping step is discontinued.

It is therefore an object of the invention to provide a sewing station and a method of using the sewing station wherein a bulky workpiece may be easily preloaded at a location spaced from a sewing location and subsequently moved into the sewing location for a sewing operation.

Other objects and advantages of the invention will be apparent from the following description, the accompanying drawings, and the appended claims.

DETAILED DESCRIPTION OF THE PREFERRED EMBODIMENT

Figure 1:
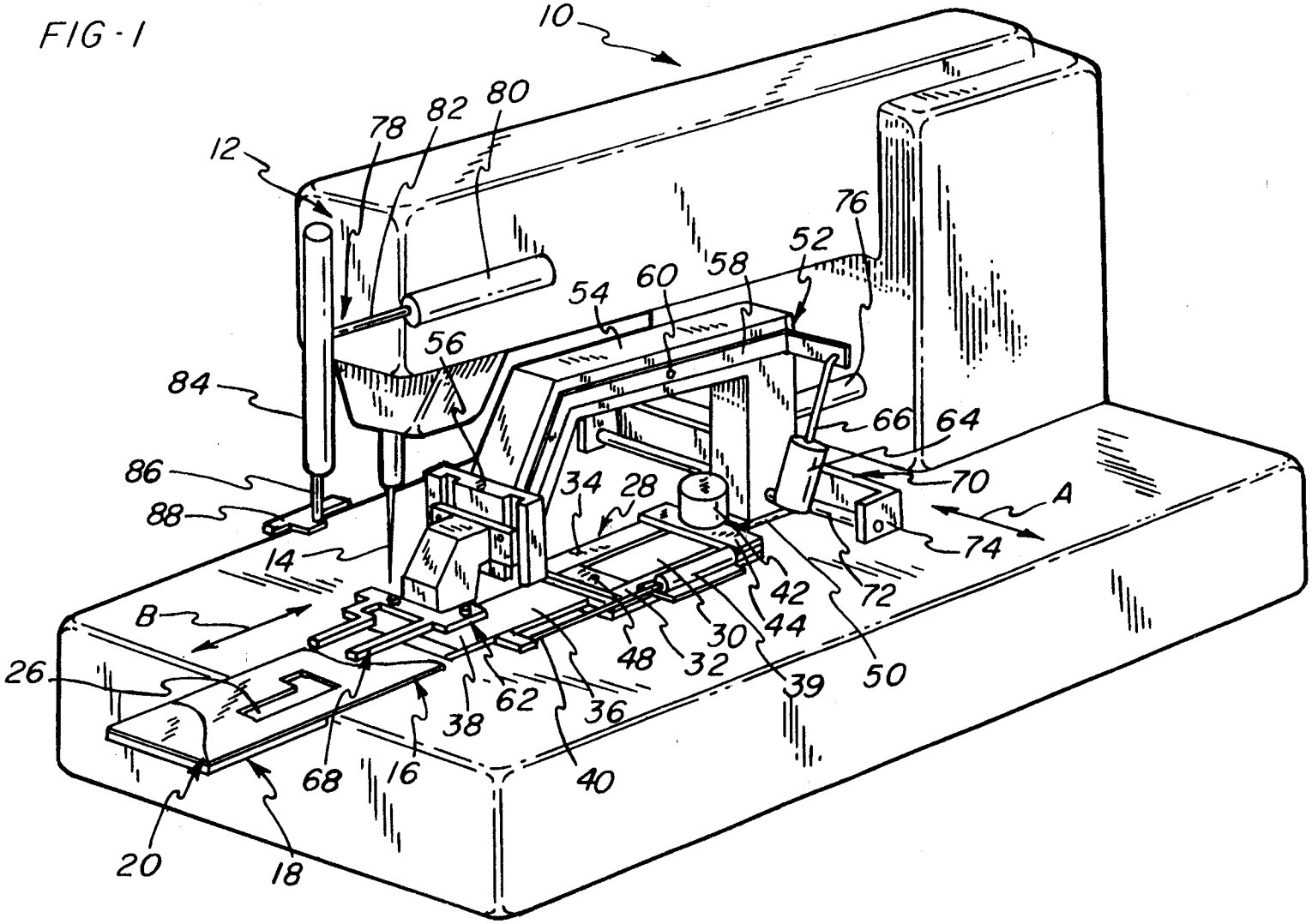
FIG. 1 is a perspective view of a sewing machine incorporating a preferred embodiment of this invention.

Referring to FIG. 1, a programmable sewing machine 10 is shown which may be used with the preferred embodiment of the present invention. The function of the sewing machine 10 is to sew a predetermined stitch pattern on a workpiece, which operation is conventional and known in the art. The sewing machine 10 includes a front sewing head portion 12 carrying a vertically reciprocating needle 14 for performing the sewing operation according to a computer program (not shown) which is controlled by a master controller (not shown) in the sewing machine 10.

The sewing machine 10 forms a part of a sewing station including a sewing location 16 located below the sewing head 12 and a loading location or station 18 located forwardly of the sewing location 16.

A cloth plate 20 is located in the sewing station and is mounted for movement between the loading location 18 and the sewing location 16, as will be described further below. The template 20 is supported from below by a loading surface 22 extending outwardly from and formed contiguously with a sewing surface 24, as may be seen in FIG. 2. The cloth plate 20 defines a movable support surface for receiving a workpiece and includes an aperture 26 formed therein in the shape of a predetermined sewing pattern to be followed by the sewing operation whereby the needle 14 may pass through the cloth plate 20 in a manner known in the art during a sewing operation.

Figure 2:
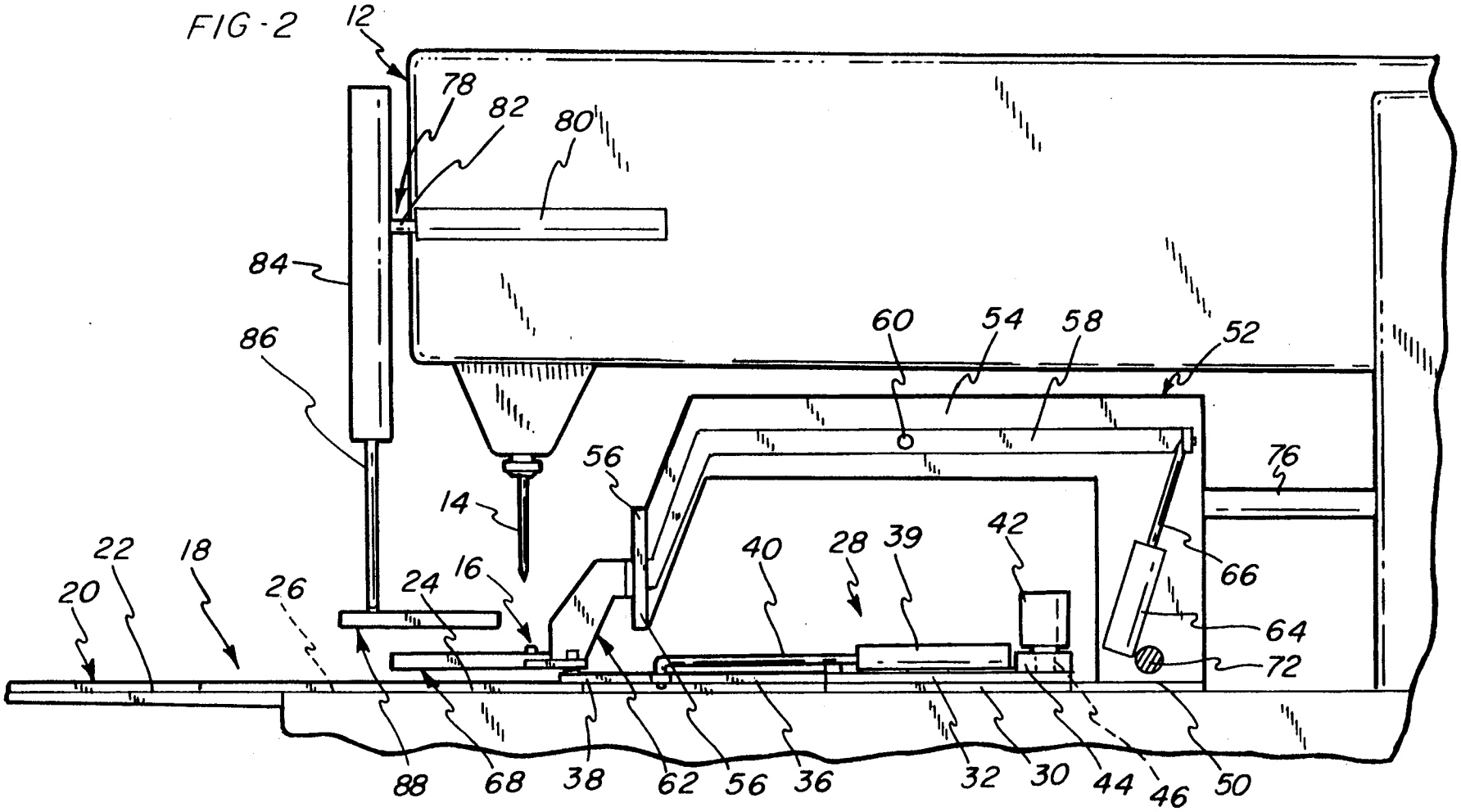
FIG. 2 is a partly broken away side view of a fragment of the sewing machine shown in FIG. 1

The cloth plate 20 forms a material receiving portion for a shuttle mechanism 28 which is adapted to move the cloth plate 20 between the loading location 18 and the sewing location 16. Referring to FIGS. 1 and 2, the shuttle mechanism 28 includes a support plate 30 to which left and right outer tracks 32, 34 are mounted. An inner track 36 is guided for sliding movement between the outer tracks 32, 34 and includes an outer end 38 which is rigidly attached to the cloth plate 20. An actuating mechanism 39 such as an air cylinder is mounted in stationary relationship to the outer tracks 32, 34 and the support plate 30, and includes an actuator rod 40 connected to the inner track 36 for causing the inner track 36 to move in sliding movement relative to the outer tracks 32, 34. Thus, actuation of the cylinder 39 will cause movement of the cloth plate 20 along a line extending between the loading location 18 and the sewing location 16.

The shuttle mechanism 28 further includes means for locking the inner track 36 in position relative to the outer tracks 32, 34 comprising an air cylinder actuator 42 mounted to a mounting bar 44. The mounting bar 44 includes an aperture for receiving a plunger 46 in reciprocating vertical movement such that when an aperture 48 formed in an end of the inner track 36 is aligned with the aperture in the mounting bar 44, the actuator 42 may be actuated to cause the plunger 46 to engage with the aperture 48 and thereby lock the inner track against movement relative to the support plate 30.

The shuttle mechanism 28 is coupled to the base portion 50 of a clamp support 52. The clamp support 52 further includes a forwardly extending arm portion 54 and an end portion 56 attached to the arm portion 54. A pivot lever 58 is mounted to one side of the arm portion 54 at a pivot point 60 and extends through the end portion 56 to support a clamp bracket 62 for vertical movement relative to the end portion 56. To this end, the end portion 56 is provided with elongated slots for accommodating the vertical movement of the pivot arm 58 and the bracket 62. An air cylinder actuator 64 is mounted adjacent to the base portion 50 of the clamp support 52 and includes an actuation rod 66 attached to an end of the pivot lever 58 opposite from the clamp bracket 62 such that actuation of the cylinder 64 results in vertical movement of the bracket 62 toward and away from the sewing surface 24. It should be noted that an additional pivotally mounted pivot lever (not shown) and actuation cylinder (not shown) are mounted on the side of the clamp support 52 opposite from the pivot lever 58 and actuation cylinder 64 to move the bracket 62 in unison with the lever 58 and cylinder 64.

The clamp bracket 62 forms a mount for mounting a sewing clamp 68 wherein the sewing clamp 68 moves together with the bracket 62 toward and away from the sewing surface 24. In addition, the sewing clamp 68 is preferably formed with a shape substantially corresponding to the shape of the aperture 26 in the cloth plate to act as a clamp around the periphery of a discrete sewing area on a workpiece to be sewn.

A conventional drive mechanism is provided for moving the clamp support 52 and shuttle mechanism 28 along a predetermined path as determined by the master controller (not shown). The drive mechanism 70 includes a shaft 72 supported by a yoke 74 for slidably mounting the base portion 50 thereon. The base portion 50 may be caused to slide along the shaft 72 to permit the clamp support 52 and shuttle mechanism 28 to move in an X direction, indicated by double arrow A in FIG. 1.

The yoke 74 is coupled to a second shaft 76 which causes the yoke 74 and attached clamp support 52 and shuttle mechanism 28 to move in Y direction, indicated by double arrow B in FIG. 1, and may be coupled to a first stepper motor (not shown) by various belts, gears and pulleys (not shown) in the sewing machine 10.

Similarly, the base portion 50 of the clamp support 52 may be coupled by various belts, gears and pulleys (not shown) to a second stepper motor (not shown) in a lower portion of the sewing machine 10. The first stepper motor (not shown) and second stepper motor (not shown) are both coupled to the master controller (not shown) in the sewing machine 10 whereby the clamp support 52 and shuttle mechanism 28 along with the respective attached sewing clamp 68 and cloth plate 20 will be selectively driven in the X and Y directions to sew a predetermined stitch pattern.

The preferred embodiment of the present invention further includes a preclamp mechanism 78 which is shown in the figures as being mounted to one side of the sewing head 12. The clamp mechanism 78 includes a clamp actuator 80 such as an air cylinder for moving a rod 82 in a reciprocating movement. An engagement actuator 84 in the form of an air cylinder is attached to the end of the rod 82, and the actuator 84 includes a vertically movable rod 86 for mounting a preclamp 88. Thus, actuation of the actuator 80 results in movement of the preclamp 88 between the loading location 18 and the sewing location 16 and actuation of the actuator 84 results in vertical movement of the preclamp 88 into and out of contact with a workpiece located on the cloth plate 20.

Figure 3:
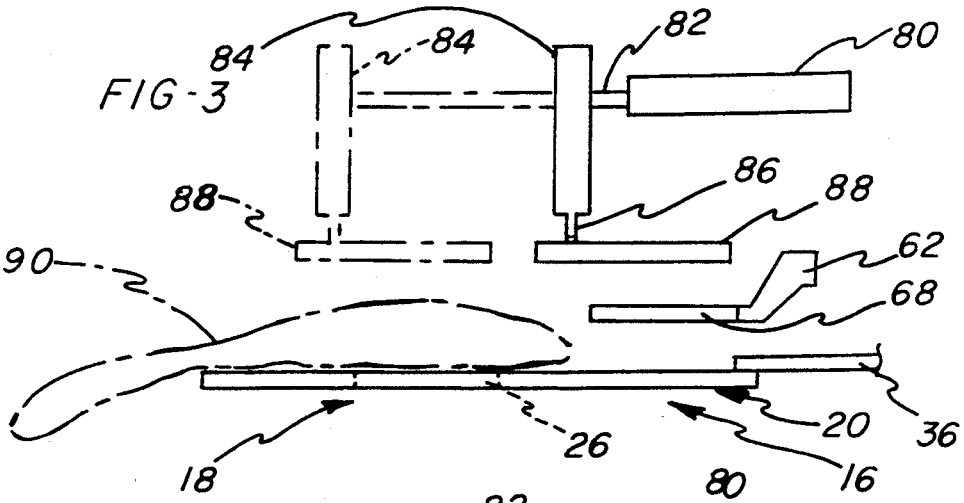
FIG. 3 is a diagrammatic elevational view showing the position of the preclamp prior to the preclamping operation.
Figure 4:
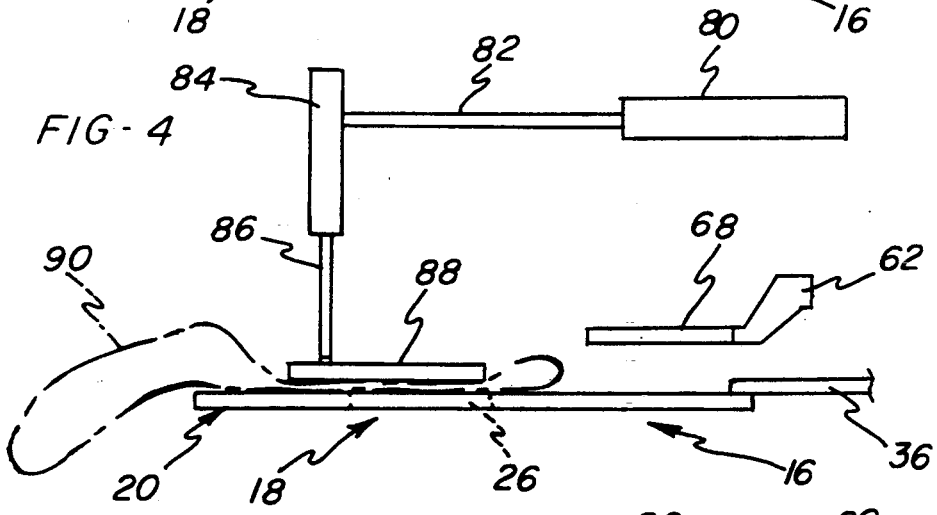
FIG. 4 is a diagrammatic elevational view showing the preclamp in contact with a bulky workpiece at the loading location.
Figure 5:
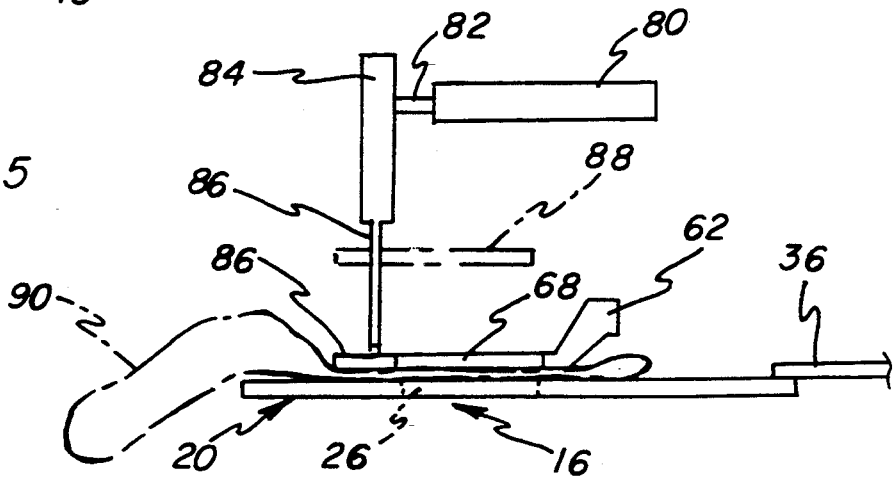
FIG. 5 is a diagrammatic elevational view showing the interchange of the sewing clamp and the preclamp at the sewing location.

Referring to FIGS. 3–5, the process of loading, preclamping and transferring a workpiece from the loading location 18 to the sewing location 16 is illustrated. As seen in FIG. 3, a workpiece, depicted diagrammatically as 90, is placed on the cloth plate 20 with the cloth plate located in an extended position placing the aperture 26 away from the sewing location 16. The clamp actuator 80 is then activated to move the preclamp 88 from an initial position adjacent to the sewing location 16 to a second position, depicted in phantom lines, where the preclamp 88 is located directly over the workpiece 90 and the aperture 26 at the loading location 18.

Referring to FIG. 4, the engagement actuator 84 is then activated to move the preclamp 88 downwardly causing an engaging surface of the preclamp 88 to contact the workpiece 90 and precompress a discrete area at a location where the sewing is to be performed.

Referring to FIG. 5, with the preclamp 88 in its preclamping position, the clamp actuator 80 and shuttle mechanism actuator 39 are actuated to simultaneously move the preclamp 88 and cloth plate 20 from the loading location 18 to the sewing location 16 where the actuator 64 is activated to move the sewing clamp 68 into contact with the workpiece 90 at the discrete precompressed area. When the sewing clamp 68 is in engaging contact with the workpiece 90, the engagement actuator 84 is activated to move the preclamp 88 upwardly out of contact with the workpiece 90 such that a clamp interchange takes place before the sewing operation. Subsequently, the drive mechanism 70 moves the clamp support 52 and shuttle mechanism 28 to align the aperture 26 with the needle 14 and the sewing operation is performed in accordance with the predetermined program of the master controller (not shown).

Figure 6:
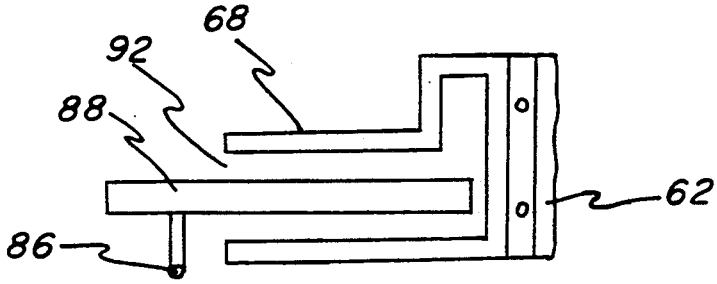
FIG. 6 is a plan view showing the interleafing cooperation between the sewing clamp and the preclamp at the sewing location.

It should be noted that the preclamp 88 and sewing clamp 68 have complementary cooperating workpiece engaging surfaces for engaging the discrete area of the workpiece 90. As may be seen in FIG. 6, the sewing clamp 68 may be formed having an elongated shape having one open side 92, and the preclamp 88 may be formed with an elongated shape for extending through the opening 92. Thus, when the sewing clamp 68 is moved downwardly into contact with the workpiece 90. Clearance is provided at the opening 92 for the preclamp 88 to move upwardly out of contact with the workpiece 90 prior to the sewing operation and this interchange of clamps is efficiently performed as a result of providing interleafed shapes for the clamps 68, 88 to engage a particular discrete area of the workpiece 90.

From the above description it should be evident that the present invention provides a sewing station which is adapted for use with bulky or unwieldy workpieces in that a shuttle and clamp system is provided for transferring a bulky or unwieldy workpiece from a loading location distal from the sewing head to a sewing station and placing it in a sewing location directly under the sewing head. The present system is particularly advantageous in that the support for the bulky or unwieldy workpiece remains connected to the sewing station such that the transfer operation may be performed without requiring coupling joints between the support and the drive mechanism for driving the support during a sewing operation. Additionally, a preclamp is provided movable independently of the support for the workpiece for preclamping the workpiece prior to a sewing operation.

While the form of apparatus herein described constitutes a preferred embodiment of the invention, it is to be understood that the invention is not limited to this precise form of apparatus and that changes may be made therein without departing from the scope of the invention, which is defined in the appended claims.

What is claimed is:

1. A sewing station comprising:

(a) means defining a loading location for reception of a bulky workpiece;

(b) A cloth plate positionable at said loading location for supporting said workpiece upon reception thereat;

(c) means defining a sewing location adjacent said loading location;

(d) a sewing head for sewing bulky workpieces positioned at said sewing location;

(e) shuttle means mounted at said sewing location and secured to said cloth plate for transporting said cloth plate and said workpiece from said loading location to said sewing location;

(f) preclamp means positionable between said sewing location and said loading location, said preclamp means being downwardly moveable for flattening said workpiece against said cloth plate and horizontally moveable for clamping said workpiece against said cloth plate during movement thereof from said loading location to said sewing location; and (g) a sewing clamp co-operable with said preclamp means for engaging said workpiece upon arrival thereof at said sewing location and maintaining said workpiece in a flattened condition against said cloth plate during sewing thereof by said sewing head.

2. A sewing station according to claim 1 wherein said preclamp means and said sewing clamp are provided with matching elongations for simultaneously engaging a common area of said workpiece.

3. A sewing station according to claim 1 wherein said cloth plate is provided with an aperture for passage therethrough of a sewing needle.

4. A sewing station according to claim 3 further comprising a drive mechanism for driving said cloth plate and said sewing clamp in a programmed pattern relative to said sewing head.

5. A sewing station according to claim 4 further comprising a locking plunger for securing said cloth plate to said shuttle means.

6. A sewing station providing for easy loading of workpieces, said sewing station comprising:

means defining a sewing location;

means defining a loading location adjacent said sewing location;

a moveable support surface;

a support actuator for moving said support surface from said loading location to said sewing location;

a clamp means positioned relative to said support surface such that a bulky workpiece easily may be loaded thereon;

clamp actuator means for moving said clamp means from an initial position above said support surface, downwardly to a second position above said support surface, and guiding said clamp means from said loading location to said sewing location in synchronism with operation of said support actuator;

a moveable sewing clamp mounted at said sewing location; and drive means mounted at said sewing location for moving said support surface, said support actuator and said sewing clamp in two directions along a programmed path.

7. The sewing station of claim 6 including a locking plunger mounted to said drive means and adapted to engage said support actuator to lock said support surface against movement relative to said drive means.

8. In a sewing station comprising a sewing head, a cloth plate for supporting a workpiece below said sewing head, a sewing clamp for clamping said workpiece against said cloth plate during said sewing, and drive means for driving said cloth plate and said sewing clamp along a programmed path relative to said sewing head during said sewing, workpiece handling means comprising:

shuttle means for moving said cloth plate from a location below said sewing head to a loading location free from obstruction by said sewing head, a preclamp for clamping said workpiece against said cloth plate while said cloth plate is at said loading location and during movement from said loading location to a location under said sewing head, and actuator means operative when said cloth plate is at said loading location for moving said preclamp into clamping relationship against said workpiece and operative for terminating said clamping relationship when said cloth plate has reached a position under said sewing head.

* * * * *